US006745394B1

(12) United States Patent
Rutherford

(10) Patent No.: US 6,745,394 B1
(45) Date of Patent: Jun. 8, 2004

(54) BALLISTIC RESISTANT BODY COVERING

(76) Inventor: Katherine P. Rutherford, 126 S. 7th Ave. #75, Mt. Vernon, NY (US) 10550

( * ) Notice: Subject to any disclaimer, the term of this patent is extended or adjusted under 35 U.S.C. 154(b) by 0 days.

(21) Appl. No.: 09/780,002

(22) Filed: Feb. 9, 2001

(51) Int. Cl.[7] ..... F41H 1/02; F41H 1/04
(52) U.S. Cl. ..... 2/2.5; 2/455; 2/466
(58) Field of Search ..... 2/2.5, 455, 457, 2/465, 464, 463, 459, 466

(56) References Cited

U.S. PATENT DOCUMENTS

| | | | | | |
|---|---|---|---|---|---|
| D111,051 | S | | 8/1938 | Reinman | |
| 4,467,476 | A | | 8/1984 | Herbert | |
| 4,497,069 | A | | 2/1985 | Braunhut | |
| 4,833,732 | A | | 5/1989 | Harmsen | |
| 5,495,621 | A | | 3/1996 | Kibbee | |
| 5,623,728 | A | * | 4/1997 | Wagner | 2/462 |
| 5,652,967 | A | * | 8/1997 | Hsu | 2/463 |
| 5,727,260 | A | * | 3/1998 | Torch et al. | 2/455 |
| 5,754,982 | A | | 5/1998 | Gainer | |
| 5,966,747 | A | * | 10/1999 | Crupi et al. | 2/466 |
| 6,026,510 | A | * | 2/2000 | Kocher | 2/2.5 |
| 6,098,196 | A | * | 8/2000 | Logan | 2/2.5 |
| 6,266,818 | B1 | * | 7/2001 | Howland et al. | 2/2.5 |
| 6,510,560 | B1 | * | 1/2003 | Ugolnik | 2/455 |

* cited by examiner

*Primary Examiner*—Robert Musomoto

(57) ABSTRACT

A ballistic resistant body covering for protecting the torso, groin and neck area from ballistic missiles. The ballistic resistant body covering includes a torso portion having a front plate and a back plate. Each of the plates is securely coupled together. The torso portion has a neck opening, a pair of arm openings and a torso opening. A groin portion has a generally cup-shape and a pair of leg openings therein. A fastening member releasably couples a top edge of the groin portion to a bottom edge of the torso portion. Each of the torso and groin portions comprises a ballistic resistant material.

5 Claims, 3 Drawing Sheets

BALLISTIC RESISTANT BODY COVERING

BACKGROUND OF THE INVENTION

1. Field of the Invention

The present invention relates to ballistic resistant body coverings and more particularly pertains to a new ballistic resistant body covering for protecting the torso, groin and neck area from ballistic missiles.

2. Description of the Prior Art

The use of ballistic resistant body coverings is known in the prior art. More specifically, ballistic resistant body coverings heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,467,476; 5,754,982; 5,495,621; 4,497,069; Des. 111,051; and 4,833,732.

While these devices fulfill their respective, particular objectives and requirements, the aforementioned patents do not disclose a new ballistic resistant body covering. The inventive device includes a torso portion having a front plate and a back plate. Each of the plates is securely coupled together. The torso portion has a neck opening, a pair of arm openings and a torso opening. A groin portion has a generally cup-shape and a pair of leg openings therein. A fastening member releasably couples a top edge of the groin portion to a bottom edge of the torso portion. Each of the torso and groin portions comprises a ballistic resistant material.

In these respects, the ballistic resistant body covering according to the present invention substantially departs from the conventional concepts and designs of the prior art, and in so doing provides an apparatus primarily developed for the purpose of protecting the torso, groin and neck area from ballistic missiles.

SUMMARY OF THE INVENTION

In view of the foregoing disadvantages inherent in the known types of ballistic resistant body coverings now present in the prior art, the present invention provides a new ballistic resistant body covering construction wherein the same can be utilized for protecting the torso, groin and neck area from ballistic missiles.

The general purpose of the present invention, which will be described subsequently in greater detail, is to provide a new ballistic resistant body covering apparatus and method which has many of the advantages of the ballistic resistant body coverings mentioned heretofore and many novel features that result in a new ballistic resistant body covering which is not anticipated, rendered obvious, suggested, or even implied by any of the prior art ballistic resistant body coverings, either alone or in any combination thereof.

To attain this, the present invention generally comprises a torso portion having a front plate and a back plate. Each of the plates is securely coupled together. The torso portion has a neck opening, a pair of arm openings and a torso opening. A groin portion has a generally cup-shape and a pair of leg openings therein. A fastening member releasably couples a top edge of the groin portion to a bottom edge of the torso portion. Each of the torso and groin portions comprises a ballistic resistant material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ballistic resistant body covering apparatus and method which has many of the advantages of the ballistic resistant body coverings mentioned heretofore and many novel features that result in a new ballistic resistant body covering which is not anticipated, rendered obvious, suggested, or even implied by any of the prior art ballistic resistant body coverings, either alone or in any combination thereof.

It is another object of the present invention to provide a new ballistic resistant body covering which may be easily and efficiently manufactured and marketed.

It is a further object of the present invention to provide a new ballistic resistant body covering which is of a durable and reliable construction.

An even further object of the present invention is to provide a new ballistic resistant body covering which is susceptible of a low cost of manufacture with regard to both materials and labor, and which accordingly is then susceptible of low prices of sale to the consuming public, thereby making such ballistic resistant body covering economically available to the buying public.

Still yet another object of the present invention is to provide a new ballistic resistant body covering which provides in the apparatuses and methods of the prior art some of the advantages thereof, while simultaneously overcoming some of the disadvantages normally associated therewith.

Still another object of the present invention is to provide a new ballistic resistant body covering for protecting the torso, groin and neck area from ballistic missiles.

Yet another object of the present invention is to provide a new ballistic resistant body covering which includes a torso portion having a front plate and a back plate. Each of the plates is securely coupled together. The torso portion has a neck opening, a pair of arm openings and a torso opening. A groin portion has a generally cup-shape and a pair of leg openings therein. A fastening member releasably couples a top edge of the groin portion to a bottom edge of the torso portion. Each of the torso and groin portions comprises a ballistic resistant material.

Still yet another object of the present invention is to provide a new ballistic resistant body covering that has three portions which may be coupled together to cover a substantial portion of a user's body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
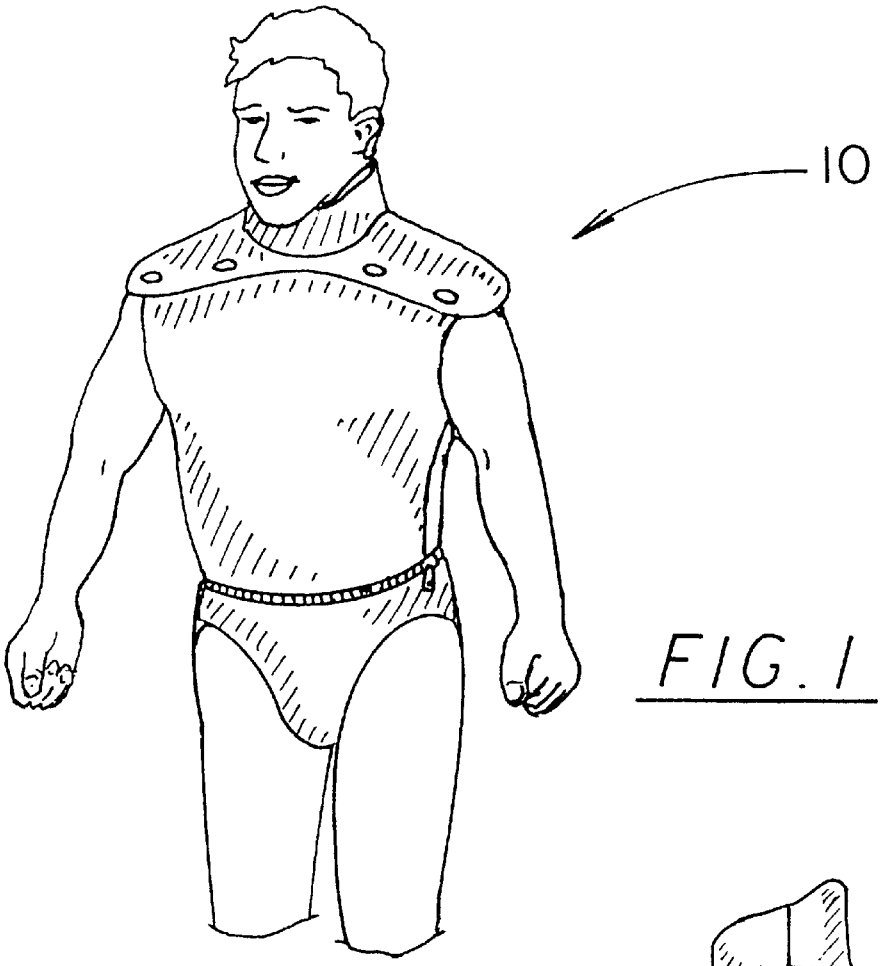
FIG. 1 is a schematic front view of a new ballistic resistant body covering according to the present invention.
Figure 2:
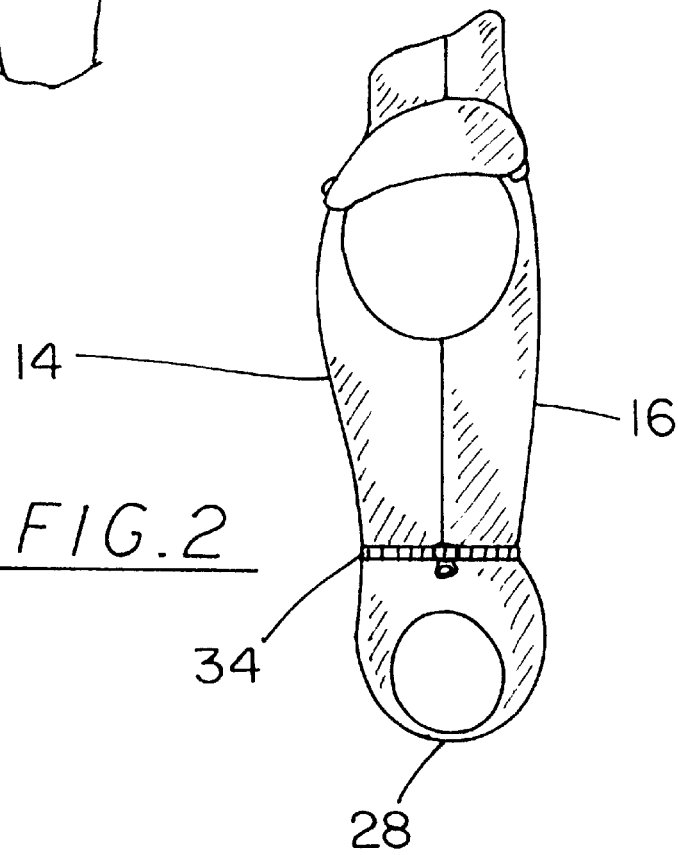
FIG. 2 is a schematic side view of the present invention.
Figure 3:
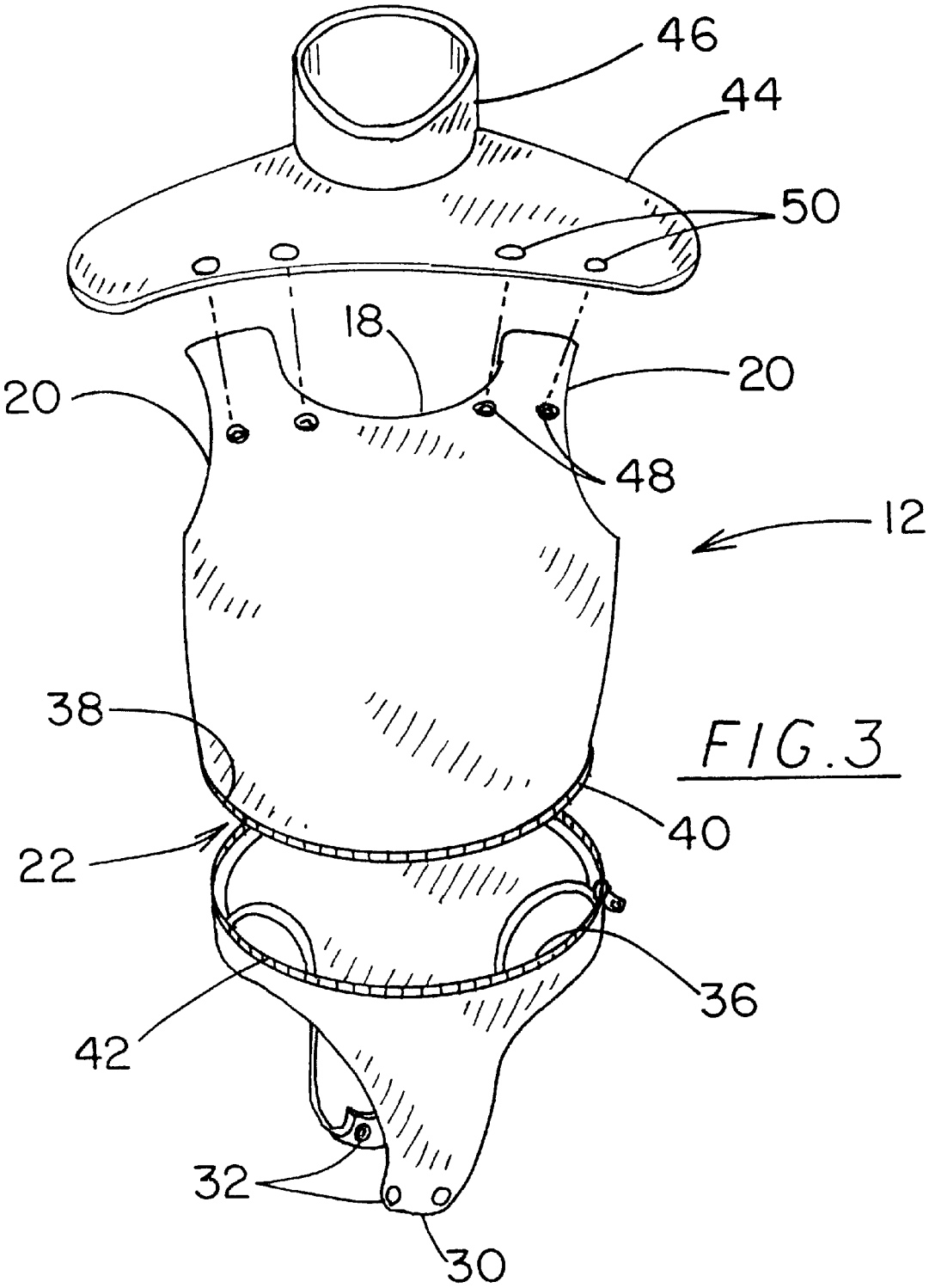
FIG. 3 is a schematic front view of the present invention.
Figure 4:
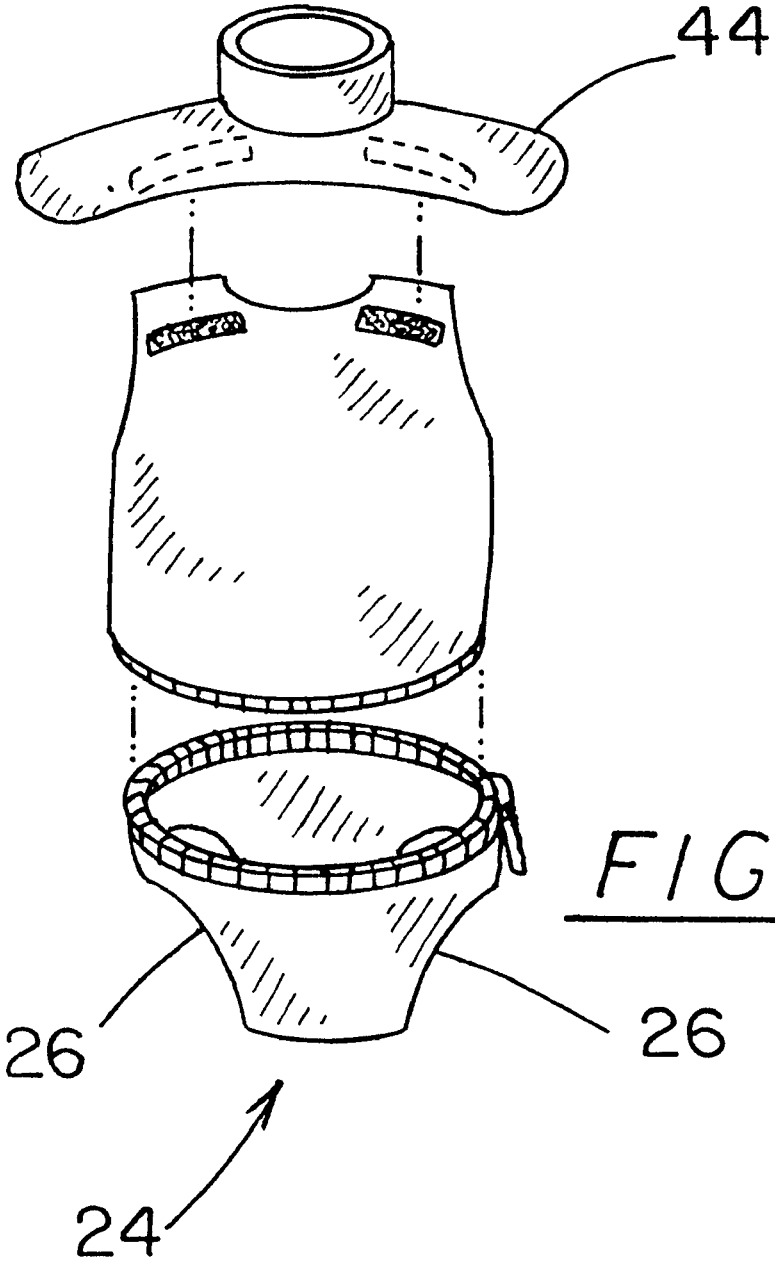
FIG. 4 is a schematic back view of the present invention.

With reference now to the drawings, and in particular to FIGS. 1 through 4 thereof, a new ballistic resistant body covering embodying the principles and concepts of the present invention and generally designated by the reference numeral 10 will be described.

As best illustrated in FIGS. 1 through 4, the ballistic resistant body covering 10 generally comprises a torso portion 12 having a front plate 14 and a back plate 16. Each of the plates 14, 16 is securely coupled together. The torso portion 12 has a neck opening 18, a pair of arm openings 20 and a torso opening 22.

A groin portion 24 has a generally cup-shape and a pair of leg openings 26 therein. A middle area 28 of the groin portion has a break 30 therein extending between the leg openings. A securing means 32, preferably either snaps or buttons, releasably secures a first edge of the break 30 to a second edge of the break.

A fastening member 34 couples a top edge 36 of the groin portion 34 to a bottom edge 38 of the torso portion 12. The fastening member 34 includes a zipper having a first zipper portion 40 for removably engaging a second zipper portion 42. The first zipper portion 40 is securely coupled to and extends about the bottom edge 38 of the torso portion 12. The second zipper portion 42 is securely coupled to and extends about the top edge 36 of the groin portion 34.

A shoulder portion 44 includes a panel having a hole extending through a central area of the shoulder portion 44. An annular lip 46 is securely coupled to and extends upwardly from an edge of the hole.

A plurality of male couplers 48 is securely coupled to a top surface of the torso portion 12 and positioned generally adjacent to the neck opening 18. A plurality of female couplers 50 is securely coupled to a bottom surface of the panel 44 and positioned such that the male couplers 48 may be removably coupled to the female couplers 50 when the hole in the panel 44 is generally coaxial to the neck opening 18. The couplers may be buttons, snaps or a hook and loop securing means.

Each of the shoulder 44, torso 12 and groin 24 portions comprises a conventional ballistic resistant material.

In use, the device 10 is worn on the body of the user and the various portions coupled together. The device protects the body from ballistic missiles over a large portion of the body including the torso, groin and neck area.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A body armor device for preventing injury by a ballistic missile, said device comprising:

a torso portion having a front plate and a back plate, each of said plates being securely coupled together, said torso portion having a neck opening, a pair of arm openings and a torso opening;

a groin portion having a generally cup-shape and a pair of leg openings therein; and a fastening member for coupling a top edge of said groin portion to a bottom edge of said torso portion; and each of said torso and groin portions comprising a ballistic resistant material.

2. The body armor device as in claim 1, wherein said groin portion further includes:

a middle area of said groin portion having a break therein extending between said leg openings, a securing means releasably securing a first edge of said break to a second edge of said break.

3. The body armor device as in claim 1, wherein said fastening member includes a zipper having a first zipper portion for removably engaging a second zipper portion, said first zipper portion being securely coupled to and extending about said bottom edge of said torso portion and said second zipper portion being securely coupled to and extending about said top edge of said groin portion.

4. The body armor device as in claim 1, further including:

a shoulder portion including a panel having a hole extending through a central area of said shoulder portion, an annular lip being securely coupled to and extending upwardly from an edge of said hole, said shoulder portion comprising a ballistic resistant material; and a plurality of male couplers being securely coupled to a top surface of said torso portion and positioned generally adjacent to said neck opening, a plurality of female couplers being securely coupled to a bottom surface of said panel and positioned such that said male couplers may be removably coupled to said female couplers, wherein said hole in said panel is generally coaxial to said neck opening.

5. A body armor device for preventing injury by a ballistic missile, said device comprising:

a torso portion having a front plate and a back plate, each of said plates being securely coupled together, said torso portion having a neck opening, a pair of arm openings and a torso opening;

a groin portion having a generally cup-shape and a pair of leg openings therein, a middle area of said groin portion having a break therein extending between said leg openings, a securing means releasably securing a first edge of said break to a second edge of said break;

a fastening member for coupling a top edge of said groin portion to a bottom edge of said torso portion, said fastening member including a zipper having a first zipper portion for removably engaging a second zipper portion, said first zipper portion being securely coupled to and extending about said bottom edge of said torso portion and said second zipper portion being securely coupled to and extending about said top edge of said groin portion;

a shoulder portion including a panel having a hole extending through a central area of said shoulder portion, an annular lip being securely coupled to and extending upwardly from an edge of said hole;

a plurality of male couplers being securely coupled to a top surface of said torso portion and positioned generally adjacent to said neck opening, a plurality of female couplers being securely coupled to a bottom surface of said panel and positioned such that said male couplers may be removably coupled to said female couplers, wherein said hole in said panel is generally coaxial to said neck opening; and each of said shoulder, torso and groin portions comprising a ballistic resistant material.

* * * * *